US007927123B2

(12) United States Patent
Zhang

(10) Patent No.: US 7,927,123 B2
(45) Date of Patent: Apr. 19, 2011

(54) BATTERY CONNECTOR

(75) Inventor: Hong-Tu Zhang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 35 days.

(21) Appl. No.: 12/585,530

(22) Filed: Sep. 17, 2009

(65) Prior Publication Data

US 2011/0065304 A1 Mar. 17, 2011

(51) Int. Cl.
*H01R 13/625* (2006.01)

(52) U.S. Cl. ..... 439/344; 439/676

(58) Field of Classification Search ..... 439/344, 439/676

See application file for complete search history.

(56) References Cited

U.S. PATENT DOCUMENTS 7,540,769 B1 * 6/2009 Shen et al. ..... 439/564
7,677,919 B1 * 3/2010 Lin ..... 439/500
2001/0021609 A1 * 9/2001 Chiang ..... 439/682
2006/0270283 A1 * 11/2006 Kumazawa et al. ..... 439/676
2009/0298343 A1 * 12/2009 Wu et al. ..... 439/627

* cited by examiner

*Primary Examiner* — Ross N Gushi
(74) *Attorney, Agent, or Firm* — Rosenberg, Klein & Lee

(57) ABSTRACT

A battery connector includes a receptacle connector and a plug connector coupled with the receptacle connector. The receptacle connector has an insulating housing defining a rectangular base and a rear wall extended upward from a rear end of the base to form a receiving room therebetween, and a plurality of terminals integrally molded in the insulating housing. The terminal has a contacting plate exposed in the receiving room. The plug connector has a base body and a plurality of mated terminals. The base body defines a plurality of terminal grooves at a bottom surface thereof, for receiving the mated terminals. The terminal groove has two receiving recess at two opposite lateral surfaces thereof and a resisting hole at a top surface thereof. The mated terminal includes a buckling tab buckled with the resisting hole and two stopping slices restraining against the rear sides of the receiving recess.

7 Claims, 5 Drawing Sheets

BATTERY CONNECTOR

BACKGROUND OF THE INVENTION

1. Field of the Invention

The present invention relates to a connector, and more particularly to a battery connector.

2. The Related Art

A conventional battery connector used in portable electronic device includes a receptacle connector and a plug connector mated with the receptacle connector. The receptacle connector has a base body and a plurality of terminals disposed in a plurality of passageways of the base body. The plug connector has an insulating housing which defines a plurality of terminal grooves for receiving a plurality of mated terminals. The mated terminal has a substantially strip-shaped contacting portion for connecting with the terminal of the receptacle connector, and a cable clipping portion capable of clipping a battery connecting wire. Nevertheless, because of frequent insertions and withdrawals occurred between the receptacle connector and the plug connector, the terminal and the mated terminal may slide with respect to the passageway and the terminal groove, respectively, along an insertion and withdrawal direction, which make the connection state between the terminals of the receptacle connector and the mated terminals of the plug connector become instability. So, it is desirable to design a battery connector having a stable electrical connection between a receptacle connector and a plug connector.

SUMMARY OF THE INVENTION

An object of the present invention is to provide a battery connector for connecting with a battery. The battery connector includes a receptacle connector and a plug connector coupled with the receptacle connector. The receptacle connector has an insulating housing. The insulating housing defines a base, two lateral walls extended upwards from two opposite sides of the base, and a preventing wall extended upwards from a rear end of the base, forming a receiving room thereamong. A plurality of terminals is integrally molded in the insulating housing. The terminal includes a first fixing plate molded in the preventing wall, a contacting plate connected with the first fixing plate and exposed in the receiving room, and a plurality of spaced second fixing plates extended downwards from a bottom edge of the contacting plate and molded in the base. The plug connector received in the receiving room of the receptacle connector has a base body. The base body defines a plurality of terminal grooves at a bottom surface thereof penetrating a front end and a rear end thereof. A top of the terminal groove defines a resisting hole. Two opposite lateral surfaces of the terminal groove are formed with two receiving recesses facing to each other. The receiving recess locates at a front end of the lateral surface and reaches the front end of the base body. A plurality of mated terminals is received in the corresponding terminal grooves. The mated terminal includes a contacting strip for contacting with the contacting plate, a connecting strip extended opposite to the contacting strip from an end of the contacting strip, and a cable clipping portion connected with the connecting strip. The connecting strip has a buckling tab corresponding to the resisting hole of the terminal groove. Two opposite sides of the cable clipping portion extend downward to form two stopping slices for resting against the rear sides of the receiving recesses.

As described above, the terminals are integrally molded in the insulating housing of the receptacle connector. The buckling tab is buckled with the resisting hole, and the stopping slices are restrained against the rear sides of the receiving recesses, which makes the mated terminal steadily fixed in the terminal groove. Thus, the connection between the plug connector and the receptacle connector is stable and reliable for the long-term use process.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
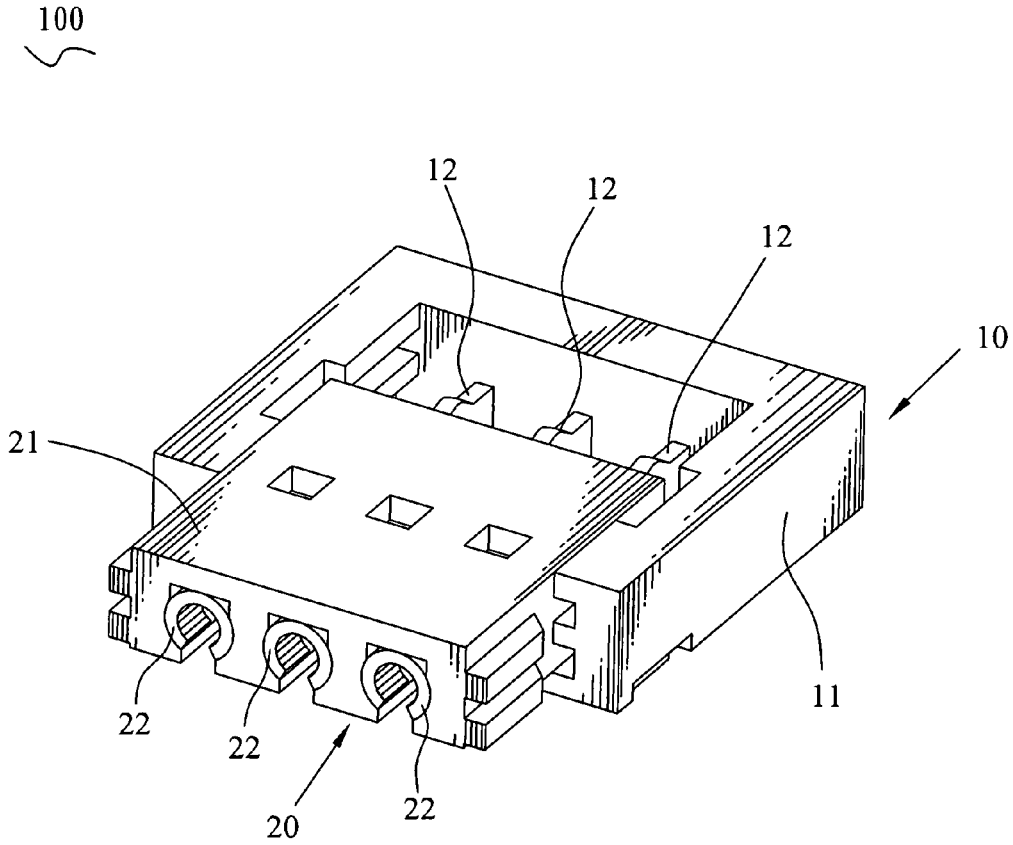
FIG. 1 is a perspective view of a battery connector in accordance with the present invention, wherein a plug connector is not fully coupled with a receptacle connector.

With reference to FIG. 1, a battery connector 100 in accordance with the present invention includes a receptacle connector 10 and a plug connector 20 mated with the receptacle connector 10.

Figure 2:
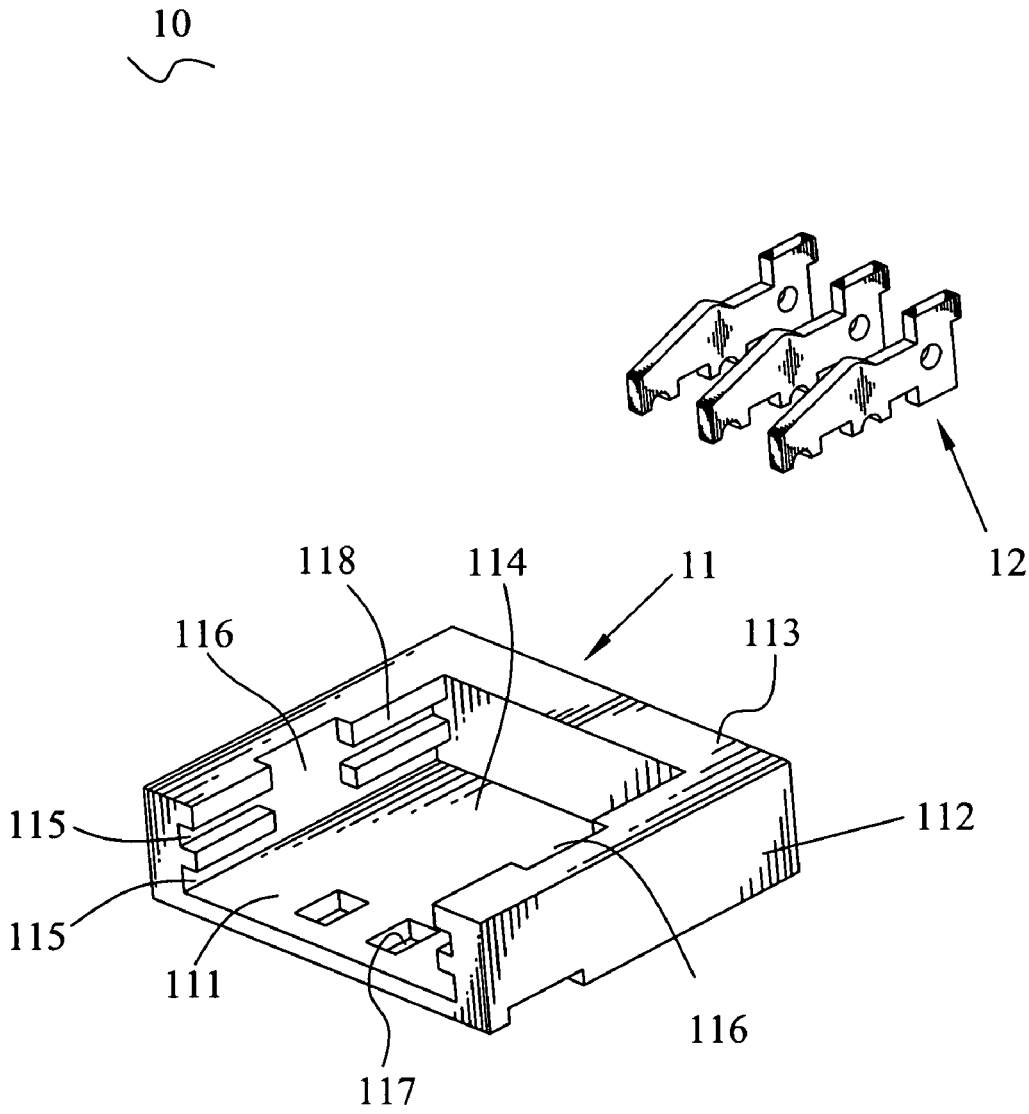
FIG. 2 is an exploded view of the receptacle connector of the battery connector shown in FIG. 1.
Figure 3:
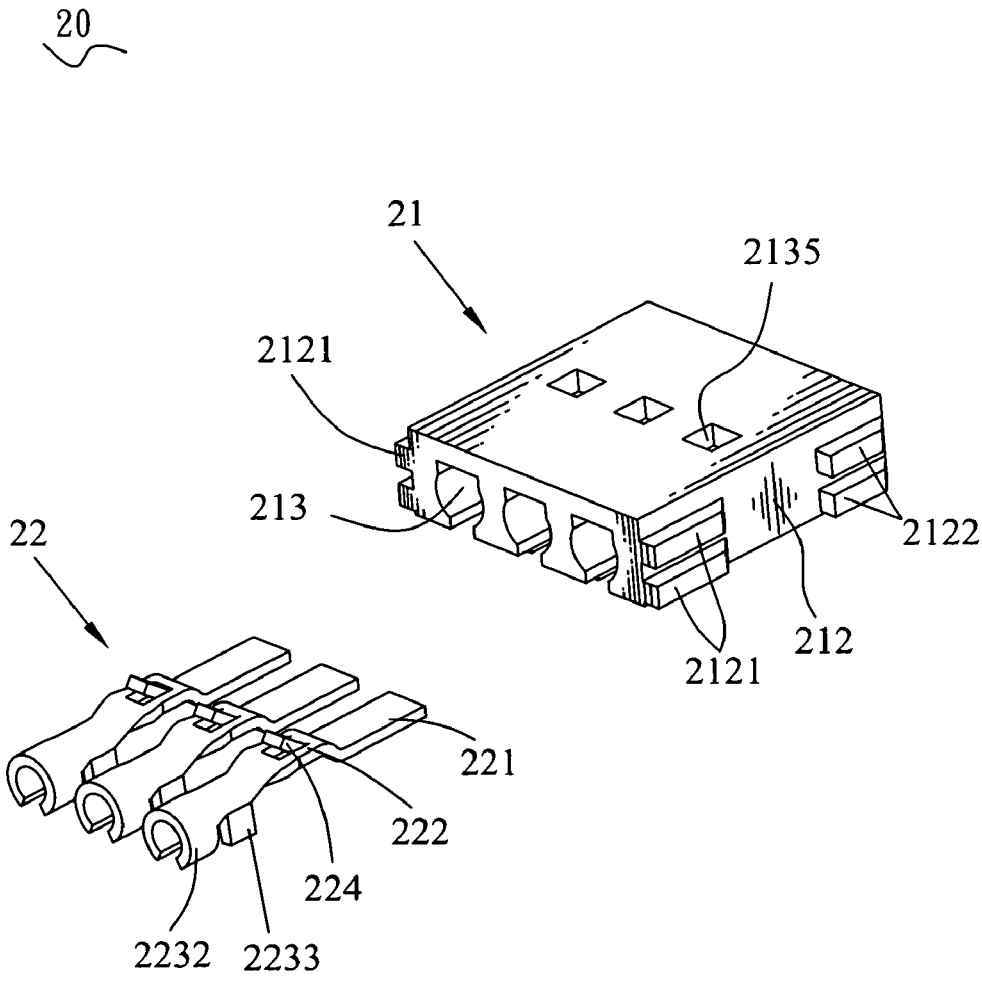
FIG. 3 is an exploded view of the plug connector of the battery connector shown in FIG. 1.

Referring to FIG. 1 to FIG. 3, the receptacle connector 10 has an insulating housing 11 and a plurality of terminals 12 molded in the insulating housing 11 along an insertion direction which is referred to as a front and rear direction, herein. The insulating housing 11 has a rectangular base 111. A front of the base 111 defines two rectangular fixing holes 117 spaced away from each other and passing therethrough. The base 111 has two lateral walls 112 respectively extended upwards from two opposite sides thereof and a preventing wall 113 extended upwards from a rear end thereof. A receiving room 114 is formed among the base 111, the two lateral walls 112 and the preventing wall 113 for accommodating the plug connector 20. The lateral walls 112 have two opposite inner surfaces 118 each of which has two guiding recesses 115. The guiding recesses 115 both extend frontward and rearward to penetrate a front end of the lateral wall 112 and are spaced from each other. The guiding recess 115 at a lower portion of the lateral wall 112 reaches a top surface of the base 111. In this embodiment, each of the inner surfaces 118 further has a divisional recess 116 extending perpendicularly to the guiding recess 115 and reaching a top of the lateral wall 112 and the top surface of the base 111. The divisional recess 116 is disposed at a substantial middle of the inner surface 118 for dividing the guiding recess 115 into a front part and a rear part.

Figure 6:
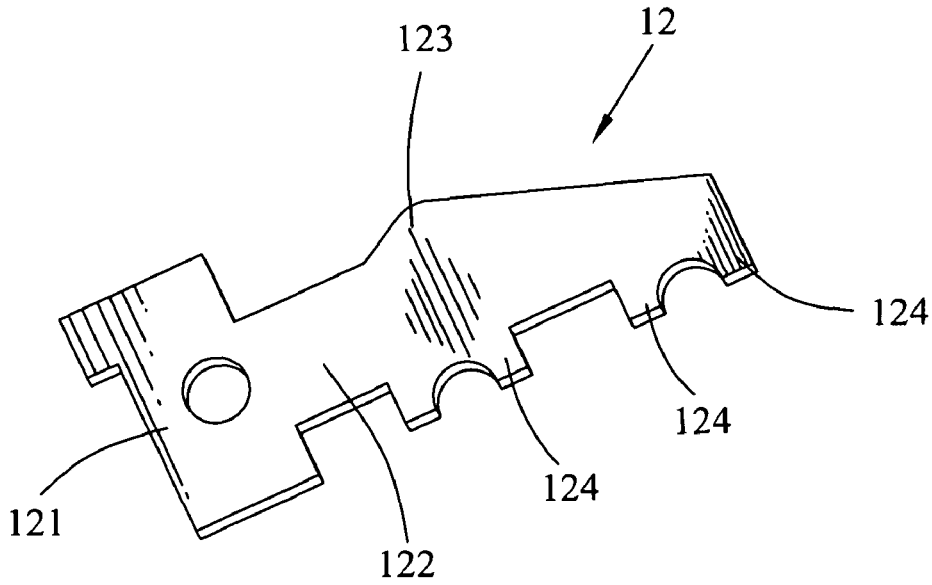
FIG. 6 is a perspective view of a terminal of the receptacle connector shown in FIG. 2 seen from another angle.

Referring to FIG. 2 and FIG. 6, the receptacle connector 10 has three terminals 12 arranged in the insulating housing 11. The terminal 12 has a substantial rectangular first fixing plate 121. A front side of the first fixing plate 121 has a substantial middle portion extended frontward and perpendicularly to form a contacting plate 122. The contacting plate 122 has a contacting protrusion 123 extended upwards from a substantial middle of a top edge thereof, and a plurality of spaced second fixing plates 124 extending downwards from a bottom edge thereof. The contacting protrusion 123 is a substantial triangle shape, having a smooth point. The first fixing plate 121 and the second fixing plates 124 are molded in the preventing wall 113 and the base 111 of the insulating housing 11 respectively, with a bottom end of the first fixing plate 121 stretching out of the base 111 for being soldered. The contacting plate 122 is exposed in the receiving room 114. In this embodiment, each of the second fixing plates 124 is formed with a notch of half-circle shape for enhancing the engagement stability between the insulating housing 11 and the terminal 12.

Figure 4:
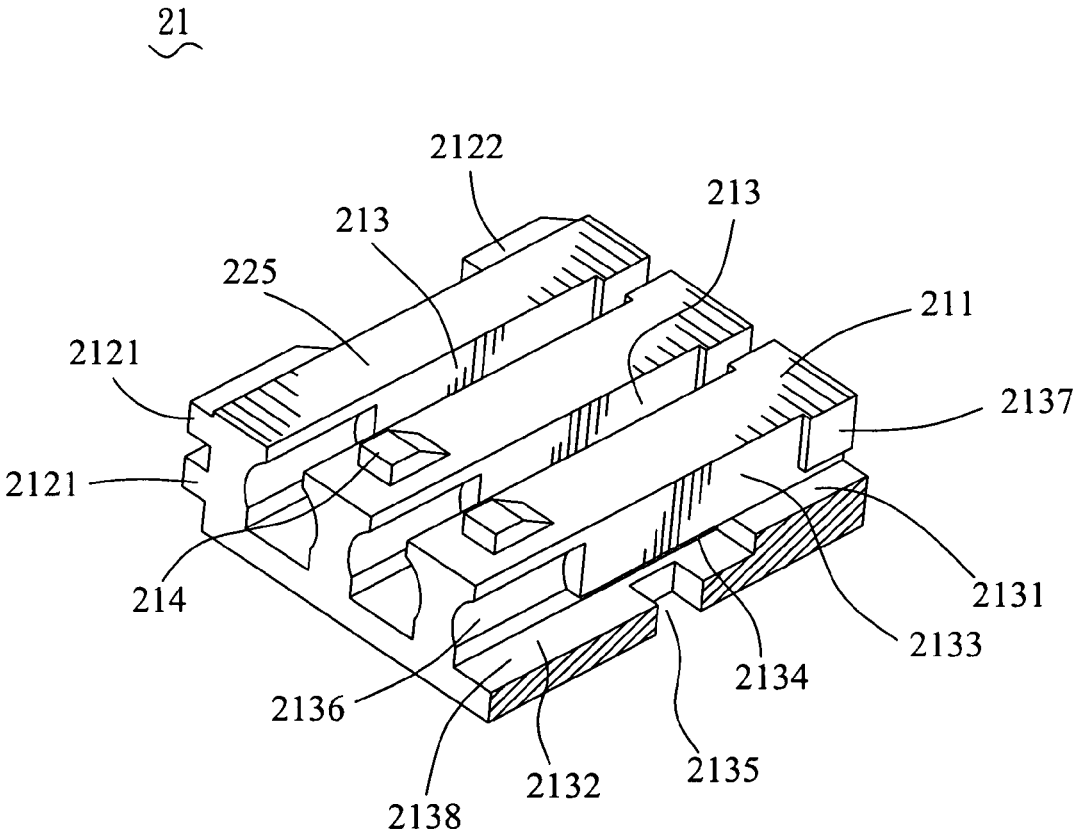
FIG. 4 is a cross-sectional view of a base body of the plug connector shown in FIG. 3 seen from a bottom angle.

Referring to FIG. 3 and FIG. 4, the plug connector 20 has a rectangular base body 21 and a plurality of mated terminals 22 disposed in the base body 21. The base body 21 defines a bottom surface 211 and two side surfaces 212 perpendicular to the bottom surface 211. Each of the side surfaces 212 has two first inserting bars 2121 and two second inserting bars 2122. The first inserting bars 2121 and the second inserting bars 2122 are respectively protruded laterally from a front end and a rear end of the side surface 212 at intervals. The first inserting bars 2121 are parallel to and spaced with each other, corresponding to the front guiding recesses 115. The second inserting bars 2122 are arranged substantially same as the first inserting bars 2121, corresponding to the rear guiding recesses 115. The bottom surface 211 has a plurality of terminal grooves 213 extending frontward and rearward to penetrate a front end and a rear end of the base body 21 for receiving the mated terminals 22. Two locking bumps 214 are formed on the bottom surface 211, corresponding to the two fixing holes 117 of the insulating housing 11. In this embodiment, there are three terminal grooves 213 on the bottom surface 211. Each of the terminal grooves 213 includes a rear groove 2131 and a front groove 2132 deeper than the rear groove 2131, with a small drop formed therebetween. The terminal groove 213 has two opposite lateral surfaces 2133. Each of the lateral surfaces 2133 has a limiting slot 2134 extending frontward and rearwards to reach the front end of the base body 21 and adjacent to a top 2138 of the front groove 2132. Two rectangular supporting portions 2137 are protruded towards each other from rear ends of the lateral surfaces 2133. The supporting portion 2137 spaces away from a top of the rear groove 2131, with a gap formed therebetween. Front ends of the two lateral surfaces 2133 are formed with two receiving recesses 2136 facing to each other, with concaved bottoms formed therein. The receiving recess 2136 is arranged below the limiting slot 2134 and communicates with the limiting slot 2134. The top 2138 of the front groove 2132 has a rectangular resisting hole 2135 penetrating a top surface of the base body 21.

Figure 5:
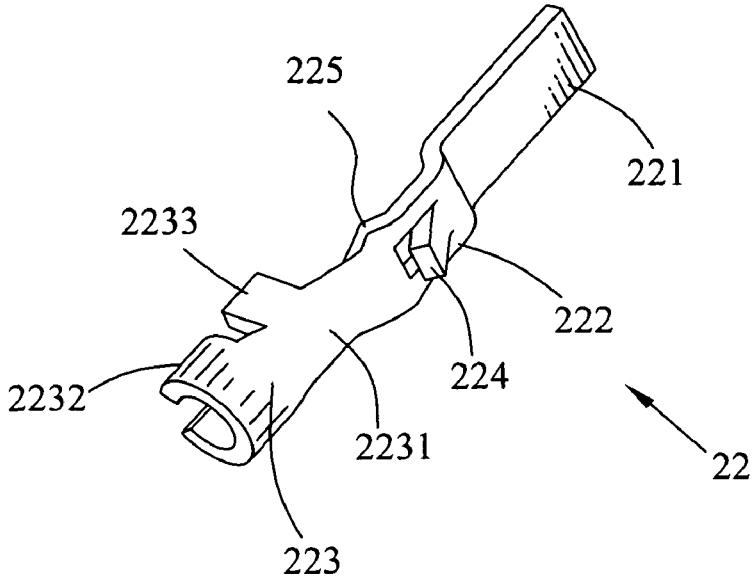
FIG. 5 is a perspective view of a mated terminal of the plug connector shown in FIG. 3 seen from another angle.

Referring to FIG. 3 and FIG. 5, the plug connector 20 has three mated terminals 22 corresponding with the three terminal grooves 213. Each mated terminal 22 has a rectangular contacting strip 221, a connecting strip 222 and a cable clipping portion 223. The connecting strip 222 is bent upwards and extends frontward from a free end of the contacting strip 221. A substantial middle portion of the connecting strip 222 is punched with a buckling tab 224, extending upwardly and obliquely. Two opposite sides of the connecting strip 222 have portions protruded oppositely to form two protrusions 225. The cable clipping portion 223 has a transition 2231 extending downwardly from a free end of the connecting strip 222, and a C-shaped ferrule 2232 integral with the transition 2231. The transition 2231 has a pair of stopping slices 2233 depending two opposite sides thereof and facing to each other.

Referring to FIG. 1 to FIG. 5, in assembly, the mated terminals 22 are inserted into the corresponding terminal grooves 213 from a front direction. The contacting strip 221 is received in the rear groove 2131 and abuts against the two supporting portions 2137. The connecting strip 222 is fixed in the front groove 2132, by the buckling tab 224 buckled with the resisting hole 2135 and the protrusions 225 jammed in the respective limiting slots 2134. The ferrule 2232 of the cable clipping portion 223 is received in the receiving recesses 2136 of the front groove 2132, with the stopping slices 2233 resting against rear sides of the receiving recesses 2136, for preventing the mated terminals 22 from moving rearwards with respect to the base body 21.

Referring to FIG. 1 to FIG. 6 again, in assembly, the second inserting bars 2122 are disposed into the respective divisional recesses 116. Afterwards, when the plug connector 20 is pushed rearward, the first inserting bars 2121 and the second inserting bars 2122 will slide along the guiding recesses 115 till the locking bumps 214 of the base body 21 buckled with the fixing holes 117 of the insulating housing 11, which makes the plug connector 20 and the receptacle connector 10 firmly engage with each other. The contacting strips 221 of the mated terminals 22 contact with the contacting protrusions 123 of the terminals 12 to achieve electrical connection. It could be noted that the assembling processing of the battery connector 100 can be changed for conforming to different demands and should not be limited.

As described above, the terminals 12 are integrally molded in the insulating housing 11. The contacting plate 122 locates in the receiving room 114 to make the contacting protrusion 123 contact with the contacting strip 221 of the mated terminal 22. The stopping slices 2233 rest against the rear sides of the receiving recesses 2136, and the buckling tab 224 buckles with the resisting hole 2135, which makes the mated terminal 22 steadily fixed in the terminal groove 213. Thus, the connection between the plug connector 20 and the receptacle connector 10 will be stable and reliable for the long-term use process.

The forgoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A battery connector, comprising:

a receptacle connector, comprising:

an insulating housing having a base, two lateral walls extended upwards from two opposite sides of the base, and a preventing wall extended upwards from a rear end of the base, forming a receiving room;

a plurality of terminals integrally molded in the insulating housing, the terminal including a first fixing plate molded in the preventing wall, a contacting plate connected with the first fixing plate and exposed in the receiving room, and a plurality of spaced second fixing plates extended downwards from a bottom edge of the contacting plate and molded in the base; and a plug connector received in the receiving room of the receptacle connector, comprising:

a base body defining a plurality of terminal grooves at a bottom surface thereof and penetrating a front end and a rear end thereof, a top of the terminal groove defining a resisting hole, two opposite lateral surfaces of the terminal groove being formed with two receiving recesses facing to each other, the receiving recess locating at a front end of the lateral surface and reaching the front end of the base body; and a plurality of mated terminals received in the corresponding terminal grooves, the mated terminal including a contacting strip for contacting the contacting plate, a connecting strip extended opposite to the contacting strip from an end of the contacting strip, and a cable clipping portion connected with the connecting strip, the connecting strip having a buckling tab corresponding to the resisting hole of the terminal groove, two opposite sides of the cable clipping portion extending downwards to form two stopping slices resting against the rear sides of the receiving recesses.

2. The battery connector as claimed in claim 1, wherein each of two facing inner surfaces of the lateral walls has two guiding recesses, extending frontward and rearward to penetrate a front surface of the lateral wall and spaced away from each other, each of two side surfaces of the base body has two inserting bars extending frontward and rearward, and sliding along the corresponding guiding recesses when the plug connector is inserted into the receptacle connector.

3. The battery connector as claimed in claim 2, wherein the inner surface of the lateral wall has a divisional recess extending upwards and downwards to divide the guiding recesses, the inserting bars has two first inserting bars and two second inserting bars corresponding to the divided guiding recesses.

4. The battery connector as claimed in claim 1, wherein each of the terminal grooves includes a rear groove for receiving the contacting strip of the mated terminal and a front groove deeper than the rear groove, with a small drop formed therebetween, the two opposite lateral surfaces of the terminal groove have two sides adjacent to a top surface of the front groove respectively recessed opposite to each other to form two limiting slots for receiving protrusions protruded oppositely from two sides of the connecting strip.

5. The battery connector as claimed in claim 1, wherein the cable clipping portion has a transition extending downwardly from a free end of the connecting strip, and a C-shaped ferrule integral with the transition, the stopping slices are extended downwardly from two opposite sides of the transition.

6. The battery connector as claimed in claim 5, wherein a bottom of the receiving recess is concaved inwards for receiving the ferrule of C-shape.

7. The battery connector as claimed in claim 5, wherein a front of the base defines two rectangular fixing holes spaced away from each other and passing therethrough, the bottom surface of the base body has two locking bumps corresponding with the two fixing holes.

* * * * *